US006102681A

United States Patent [19]

Turner

[11] Patent Number: 6,102,681

[45] Date of Patent: Aug. 15, 2000

[54] STATOR ESPECIALLY ADAPTED FOR USE IN A HELICOIDAL PUMP/MOTOR

[75] Inventor: William E. Turner, Bethlehem, Pa.

[73] Assignee: APS Technology, Cromwell, Conn.

[21] Appl. No.: 08/950,993

[22] Filed: Oct. 15, 1997

[51] Int. Cl.[7] ..... F03C 2/08; F04C 2/107; F04C 5/00

[52] U.S. Cl. ..... 418/48; 418/153

[58] Field of Search ..... 418/48, 152, 153

[56] References Cited

U.S. PATENT DOCUMENTS

| | | | |
|---|---|---|---|
| 2,409,688 | 10/1946 | Moineau | 418/48 |
| 2,695,694 | 11/1954 | Seinfeld | 418/48 |
| 2,862,454 | 12/1958 | Alcock | 418/48 |
| 2,957,427 | 10/1960 | O'Connor | 418/48 |
| 3,139,035 | 6/1964 | O'Connor | 418/48 |
| 3,417,664 | 12/1968 | Brucker | 418/152 |
| 3,514,238 | 5/1970 | Smith | 418/153 |
| 3,986,799 | 10/1976 | McCullough | 418/56 |
| 4,014,631 | 3/1977 | Goloff | 418/85 |
| 4,021,163 | 5/1977 | Morita et al. | 418/83 |
| 4,037,998 | 7/1977 | Goloff | 418/83 |
| 4,047,855 | 9/1977 | Goloff et al. | 418/53 |
| 4,120,620 | 10/1978 | Campos et al. | 418/83 |
| 4,187,061 | 2/1980 | Jurgens | 418/48 |
| 4,415,316 | 11/1983 | Jurgens | 418/48 |
| 4,583,926 | 4/1986 | Mitsumori et al. | 418/137 |
| 4,836,759 | 6/1989 | Lloyd | 418/56 |
| 5,011,389 | 4/1991 | Timuska | 418/152 |
| 5,135,059 | 8/1992 | Turner et al. | 175/101 |
| 5,145,342 | 9/1992 | Gruber | 418/48 |
| 5,171,138 | 12/1992 | Forrest | 418/48 |
| 5,171,139 | 12/1992 | Underwood et al. | 418/48 |
| 5,310,320 | 5/1994 | Timuska | 416/241 |
| 5,588,818 | 12/1996 | Houmand et al. | 418/5 |
| 5,618,171 | 4/1997 | von Behr et al. | 418/152 |
| 5,759,019 | 6/1998 | Wood et al. | 418/48 |

FOREIGN PATENT DOCUMENTS

| | | | |
|---|---|---|---|
| 454622 | 1/1928 | Germany . | |
| 1254901 | 11/1967 | Germany | 418/83 |
| 2316127 | 10/1974 | Germany | 418/48 |
| 27 13 468 | 9/1978 | Germany | 418/48 |
| 3229446 | 2/1984 | Germany | 418/48 |
| 40 06 339 | 8/1991 | Germany | 418/48 |
| 856601 | 12/1960 | United Kingdom | 418/83 |
| 1018728 | 2/1966 | United Kingdom . | |

OTHER PUBLICATIONS

Wladimir Tiraspolsky, *Hydraulic Downhole Drilling Motors,* Chapter IV, Gulf Publishing Co. (1985).

*Primary Examiner*—John J. Vrablik

*Attorney, Agent, or Firm*—Woodcock Washburn Kurtz Mackiewicz & Norris LLP

[57] ABSTRACT

A fluid handling device such as a helicoidal pump or motor having a stator formed by an elastomer material in which a plurality of fibers are encapsulated. Preferably, the fibers form a network of interlaced fibers extending in two or more directions. The fiber network preferably forms multiple layers of flexible fabric encircling the stator axis. In addition, a group of the fibers can extend radially through the fabric layers. The fibers increase the strength and stiffness of the elastomer and also create heat conduction paths that improve the heat transfer within the stator core, thereby preventing overheating of the elastomer.

38 Claims, 7 Drawing Sheets

STATOR ESPECIALLY ADAPTED FOR USE IN A HELICOIDAL PUMP/MOTOR

FIELD OF THE INVENTION

The current invention is directed to a stator for a fluid handling device such as a fluid driven motor or a pump. More specifically the current invention is directed to an improved stator for a helicoidal positive displacement pump/motor.

BACKGROUND OF THE INVENTION

Helicoidal positive displacement pumps, sometimes referred to as Moineau-type pumps, have a wide variety of applications, including the oil producing and food processing industry, where they are used to pump fluids containing solids. In addition, helicoidal motors, which are essentially helicoidal pumps operating in reverse, are used widely in the oil drilling industry. In this application, the drilling mud is used as the driving fluid for a helicoidal motor that serves to rotate the drill bit.

Typically, a helicoidal pump/motor is comprised of a stationary stator and a helical rotor that orbits eccentrically as it rotates within the stator. The rotor is typically metallic and has one or more helical lobes spiraling around its outside diameter. The stator has a number of helical lobes that form grooves in the stator inner surface that spiral along its length, with the number of helical lobes in the rotor being one less than the number of helical grooves in the stator.

The stator of a helicoidal pump/motor is typically formed by encasing an elastomeric material, which forms the helical grooves, within a cylindrical metal housing. An interference fit is provided between the stator elastomeric form and the rotor for scaling purposes. As a result of is interference fit, the elastomeric form undergoes deformation as the rotor lobes traverse the surfaces of the stator grooves. Thus, the stator must be strong enough to maintain the dimensional stability necessary to ensure a controlled interference fit and durable enough to withstand abrasion from particles in the fluid, yet be sufficiently flexible to deform under the action of the rotor. Consequently, the maximum capability of a helicoidal pump/motor, e.g., the maximum output torque in the case of a motor, is typically limited by the strength of the elastomer.

Unfortunately, the hysteresis associated the repeated cyclic stresses induced by the stator elastic deformation can generate substantial heat. Conventional helicoidal pump/motor stators cannot dissipate heat quickly. Consequently, overheating of the elastomer may result. Over time, such overheating causes deterioration and embrittlement of the elastomer. Such deterioration can lead to failure of the stator, for example, by a phenomenon known as "chunking," in which large pieces of the elastomer are torn off under the action of the rotor. One proposed solution to this problem involves the incorporation of helical tubes within the stator. According to this approach, a portion of the working fluid, typically drilling mud, is diverted so as to flow through the tubes, bypassing the normal flow path and aiding in the transfer of heat from the elastomer. Such an approach is disclosed in U.S. Pat. No. 5,171,139 (Underwood et al.). However, as a result of bypassing a portion of the working fluid, this approach results in decreased performance of the motor. Moreover, if the tubes are narrow, they can become clogged with debris carried along with the working fluid.

Consequently, it would be desirable to provide a stator for a helicoid type pump/motor having improved heat transfer characteristics and increased durability, stiffness and strength.

SUMMARY OF THE INVENTION

It is an object of the current invention to provide an improved stator for a fluid handling device having improved heat transfer characteristics and increased durability, stiffness and strength. This and other objects is accomplished in a helicoidal fluid handling device, such as that suitable for use as a positive displacement pump or motor, that includes (i) an elongate rotor having at least one lobe projecting radially outward and extending helically along its length, and (ii) a stator enclosing the rotor that and forming an inner surface in which a number of grooves project radially inward and extend helically along the stator length, with the number of grooves being one more than the number of lobes in the rotor. The stator comprises a network of fibers encapsulated in an elastomeric material. The fibers increase the strength and stiffness of the elastomeric form and also create heat conduction paths that improve the heat transfer within the stator, thereby preventing overheating of the elastomer.

In a preferred embodiment of the invention, the network of fibers comprises at least first and second groups of fibers. The fibers in the first group extend in a first direction, such as the axial, radial, circumferential, or helical direction, while the fibers in the second group extend in a second direction. In one embodiment of the invention, the fibers in the first and second groups extend in mutually perpendicular directions and are interlaced so as to form one or more layers of fabric. Preferably, the fibers form a number of layers that are circumferentially arranged so as to encircle the stator axis.

DESCRIPTION OF THE PREFERRED EMBODIMENT

Figure 1:
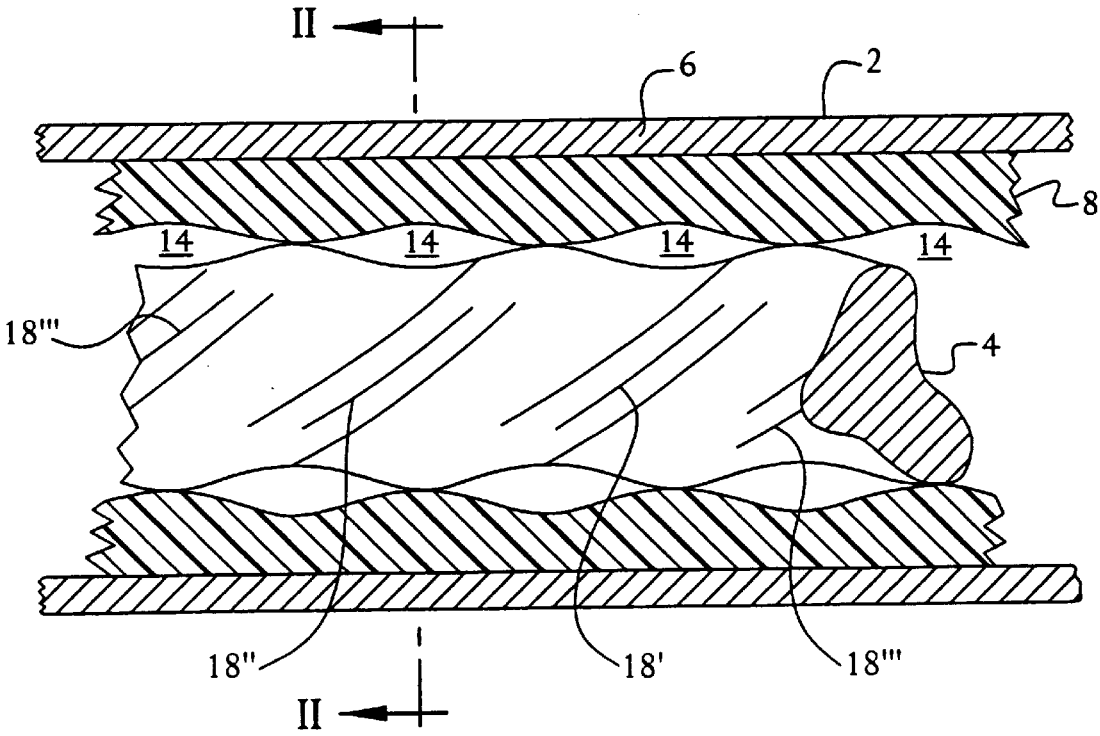
FIG. 1 is longitudinal cross-section through a helicoidal pump/motor according to the current invention.
Figure 2:
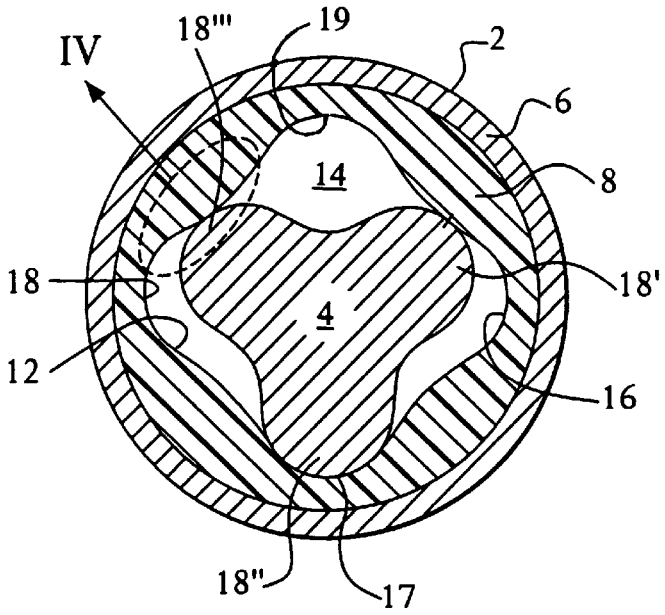
FIG. 2 is a cross-section taken along line II—II shown in FIG. 1.
Figure 3:
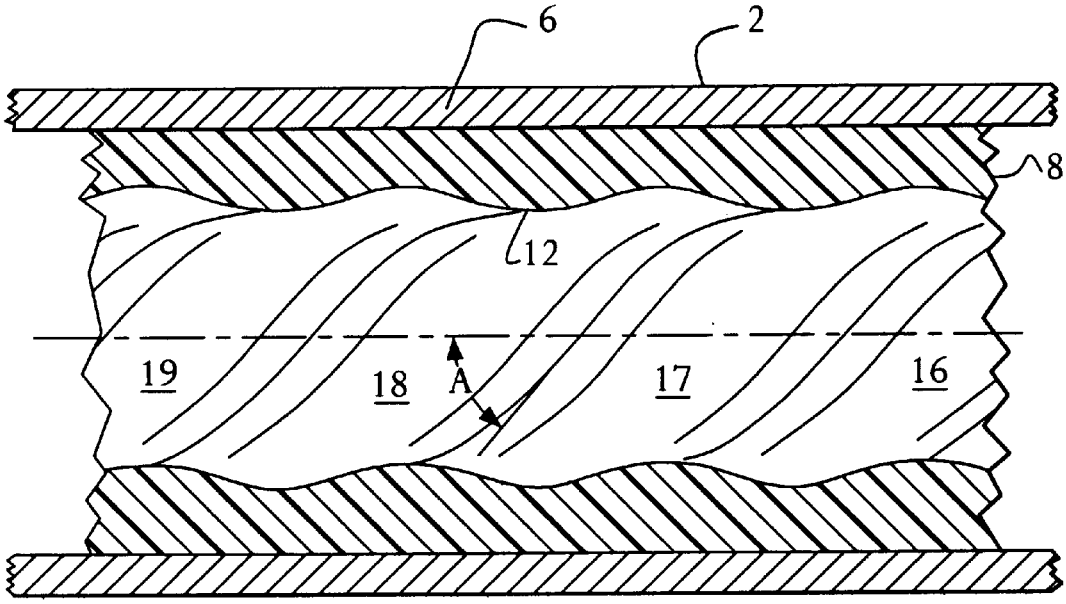
FIG. 3 is a longitudinal cross-section through the stator shown in FIG. 1.

A helicoidal pump/motor according to the current invention is shown in FIGS. 1 and 2. As is conventional, the pump/motor is comprised of a stator 2 and an elongate rotor 4. The rotor 4 is preferably formed from a metal and features three radially outward projecting lobes 18', 18", 18"' each of which has two opposing convex sides, equally spaced about its periphery. As shown best in FIG. 1, the lobes extend helically around the rotor 4 along its length. The stator 2 has a core 8 encased within a cylindrical housing 6. The stator core 8 is an elastomeric form having an inner surface 12. The inner surface 12 has an undulating profile that forms four radially inward extending grooves 16–19. As shown best in FIG. 3, the grooves 16–19 extend helically around the stator axis along the length of the stator 2. Consequently, the grooves 16–19 arc oriented at helix angle "A" with respect to the stator axis.

For purposes of illustration, FIGS. 1 and 2 show the rotor as having three lobes 18', 18", and 18"' and the stator as having four grooves 16–19. However, as those skilled in the art will readily appreciate, the invention could be practiced in helicoidal pump/motors with greater or lesser numbers of rotor lobes and stator grooves. However, in order to function as a helicoidal pump or motor, the rotor must have at least one lobe and the number of grooves in the stator should equal the number of rotor lobes plus one. Consequently, the pitch of the stator grooves is equal to the pitch of the rotor lobes multiplied ratio of the number of stator grooves to the number of rotor lobes.

When the rotor 4 is encased by the stator 2, a series of sealed helical cavities 14, each of which extends one pitch length, are formed between them, as shown in FIGS. 1 and 2. As the rotor 4 rotates, its center line orbits around the centerline of the stator 2. This rotation of the rotor 4 causes the seal cavities 14 to "move" helically along the length of the rotor. If the apparatus is a pump, rotation of the rotor 4 causes the sealed cavities 14 to transport the fluid being pumped. If the apparatus is a motor, the transport of the fluid through the cavities 14 imparts a torque that drives the rotation of the rotor 2. Although in conventional helicoidal pump/motors, the stator 2 is a stationary member and the rotor 4 is a rotating member, it is only necessary that one of the members rotate relative to the other member. For example, a helicoidal pump/motor could also be operated by rotating the stator about a rotor that is held stationary. Consequently, as used herein the term stator refers to the outer member, whether stationary or rotating, and the term rotor refers to the inner member, whether stationary or rotating, than is encircled by the stator.

According to the current invention, the stator core 8 elastomeric form is comprised of an elastomer 9 in which fibers are dispersed so as to be encapsulated by the elastomer. The fibers are preferably made from a material having high strength and good heat transfer characteristics, such as a metal, and are most preferably made from copper or steel. However, other materials, such as Kevlar™ or graphite could also be used. In general, any material, whether organic or inorganic, that is capable of increasing the strength or heat transfer characteristics of the stator can be advantageously used. The fibers are preferably of relatively small diameter, and most preferably are about 0.003 to about 0.010 inch in diameter. The fibers could be in the form of wires or could be made from a composite of very small diameter fibers, such as occurs in ravings or yarns. The elastomer 9 is preferably formed from nitrile, especially a highly saturated nitrile, or a fluorocarbon elastomer. However, other elastomers having sufficient strength and flexibility could also be utilized.

Figure 4:
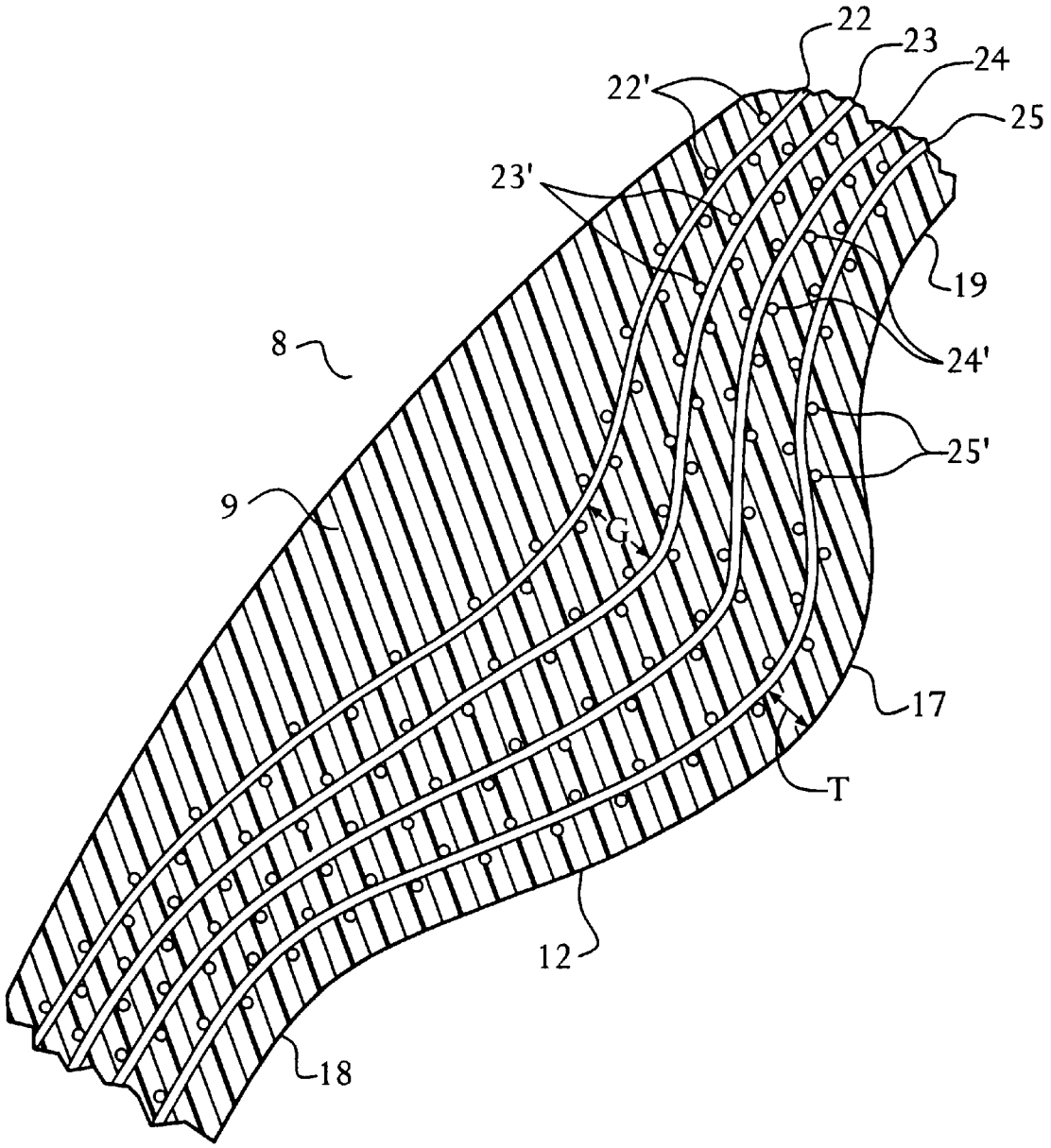
FIG. 4 is a detailed view of a portion of the stator core shown FIG. 2 enclosed by the ellipse denoted by IV.
Figure 5A:
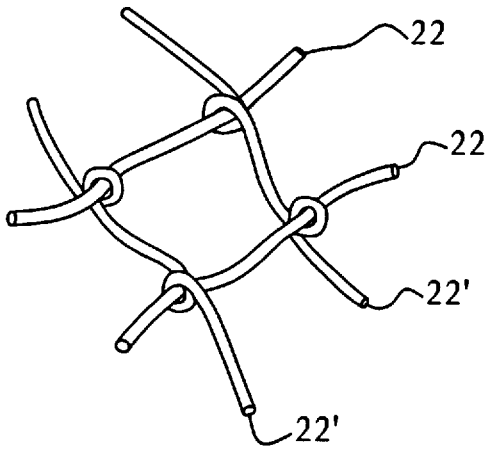
FIG. 5*a* is an isometric view of an alternate embodiment of the fiber interlacing arrangement shown in FIG. 5.
Figure 5:
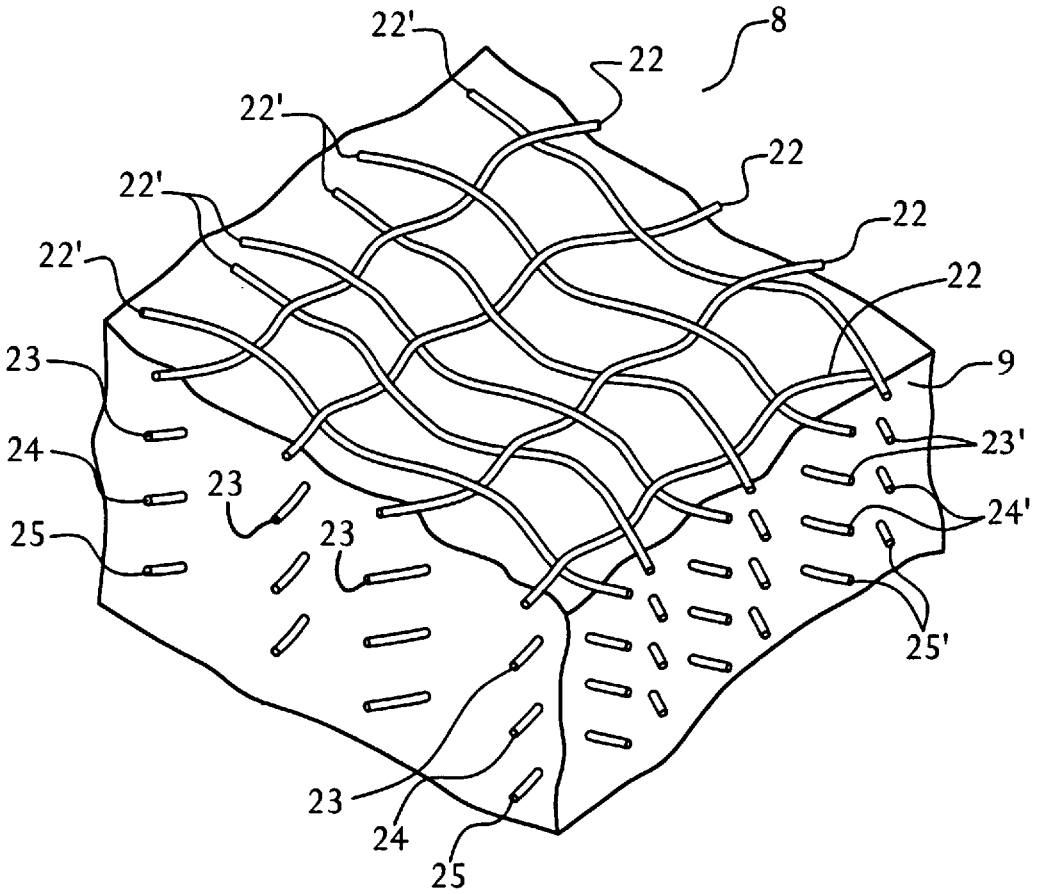
FIG. 5 is a detailed isometric view of a portion of the stator core shown in FIG. 4 with the outermost layer of elastomer removed for clarity.

Preferably, the fibers extend in at least two different directions so as to form a multi-dimensional network of fibers. One such network of fibers is shown in FIGS. 4 and 5. In this embodiment, a first group of fibers 22 extends in a first direction, for example, parallel to the stator axis, or circumferentially around the stator, or in the direction of the stator helix angle A. A second group of fibers 22' extends in a second direction. As shown best in FIG. 5, preferably, fibers 22 extend in a direction that is approximately perpendicular to the direction in which the fibers 22' extend, although such perpendicularity is not necessary to achieve benefit from the invention. For example, if fibers 22 extend axially, then fibers 22' extend transverse to the axis, or circumferentially. Alternatively, if fibers 22 extend parallel to the helix angle A of the stator, then fibers 22' extend at an angle perpendicular to the helix angle.

As shown in FIGS. 4 and 5, preferably, the fibers 22 and 22' are interlaced. More preferably, the fibers 22 and 22' are interlaced so that they contact each other, as shown in FIG. 4. Contact between the fibers aids in the conduction of heat throughout the fiber network and, therefore, through the elastomer 9. Interlacing can be achieved by weaving together multiple fibers, for example, into a layer of flexible fabric. The fibers may also be interlaced by knitting them together, for example as shown in FIG. 5*a*, thereby interlocking the fibers with respect to each other. Such interlocking has the advantage of restraining relative motion between the fibers as the stator core 8 undergoes deflection, thereby increasing the stiffness of the core 8 and reducing the heat generation. In addition, interlocking assures good contact between fibers from different groups, thereby facilitating the transfer of heat along the network of fibers. Alternatively, or in addition to knitting all or a portion of the fibers can be interlocked by brazing or epoxying the fibers together where they cross so as to restrain relative motion and ensure good contact between the fibers.

Preferably, the fibers are arranged in multiple layers extending cylindrically around the stator so that, in transverse cross-section, they form approximately concentric layers that encircle the axis of the stator core 8, as shown in FIG 4. Preferably, each layer is formed by an array of fibers extending in two directions, as previously discussed. FIGS. 4 and 5 show a four layer arrangement. The outermost layer is formed by fibers 22 and 22'. The innermost layer is formed by fibers 25 and 25', arranged similarly to fibers 22 and 22'. Intermediate layers are formed by fibers 23, 23' and fibers 24, 24'. As shown in FIG. 5, gaps are formed between each of the fibers in a given layer. Moreover, each layer of fibers is displaced from the adjacent fiber layer so as to form a radial gap G, shown in FIG. 4. Preferably, elastomer 9 substantially fills each of these gaps. Although four layers are shown in FIGS. 4 and 5, a greater number of layers could be used if desired. In general, the greater the thickness of the stator, the larger the number of layers that should be used.

Figure 4A:
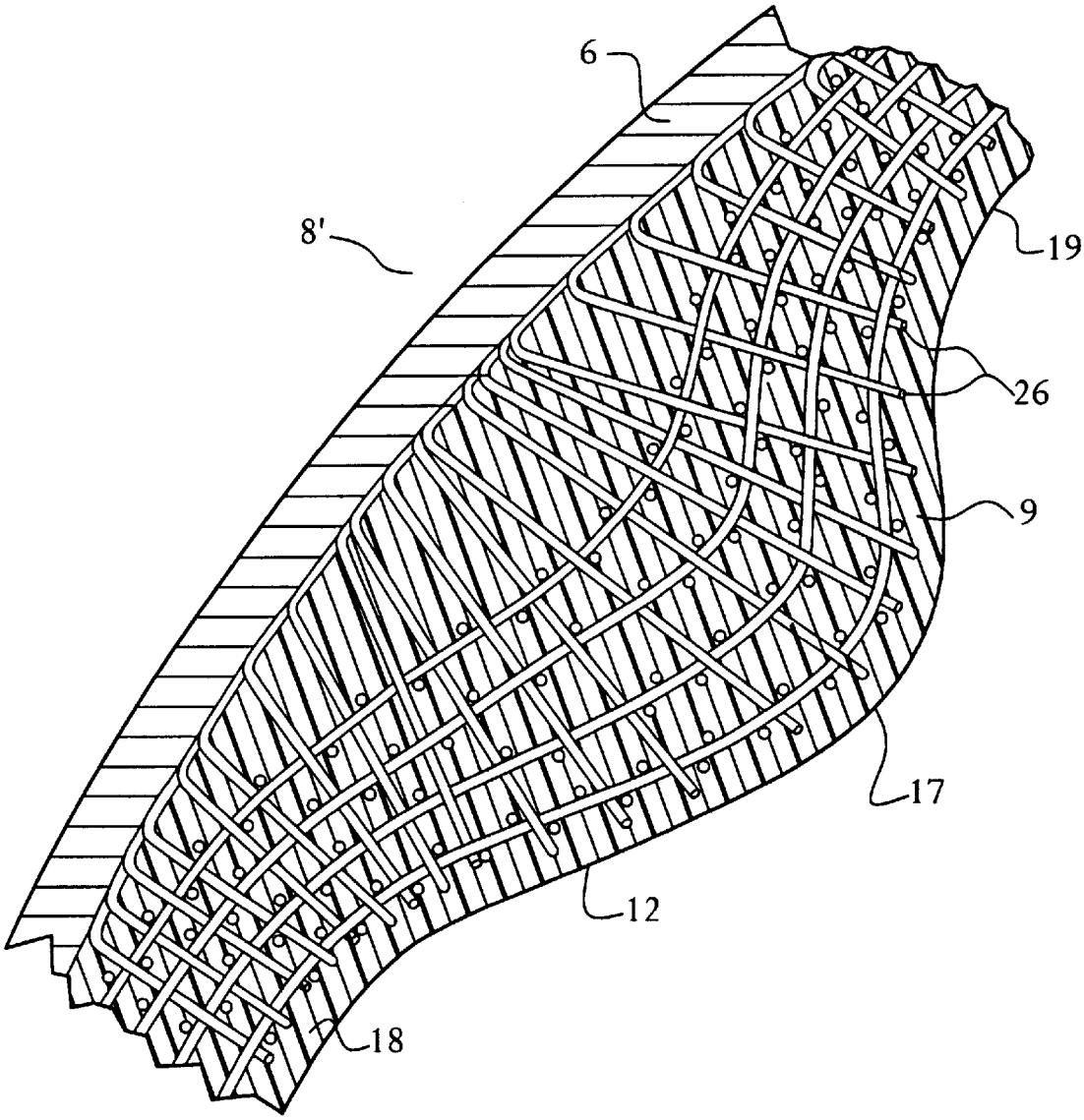
FIG. 4*a* is a detailed view similar to FIG. 4 showing an alternate embodiment in which one group of fibers extends radially.

In another embodiment of the current invention, the first two groups of fibers 22–25 are interlaced with a third group of fibers 26 extending in yet another direction, as shown in FIG. 4*a*. The fibers 26 in the third group preferably extend in the radial direction through the layers of fibers 22–25. Most preferably, the ends of the fibers 26 are in contact with the housing 6. Such contact is preferably assured by brazing or epoxying the fibers 26 to the housing 6. As discussed further below, contact between the fibers and the housing 6 can further aid in transferring heat from the stator core 8.

Figure 8:
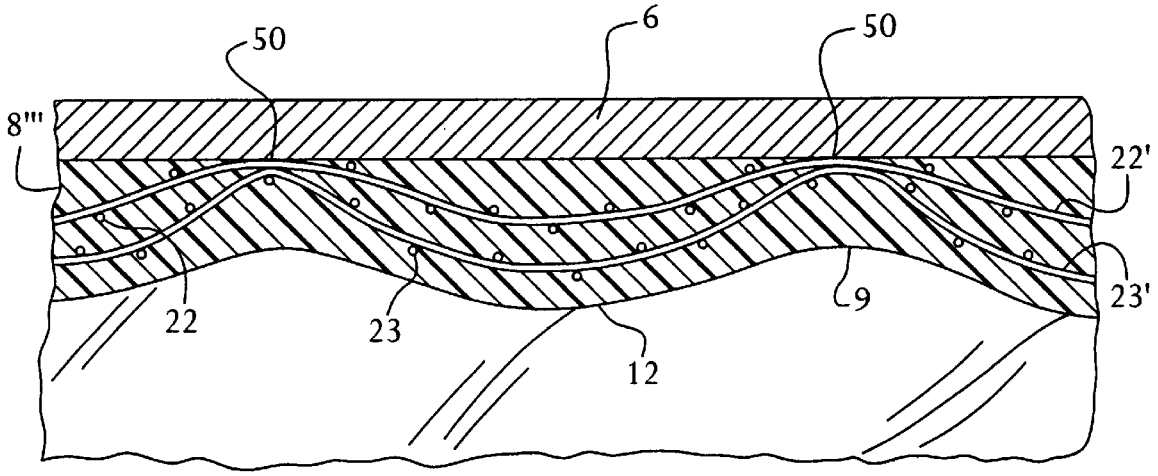
FIG. 8 is a detailed view of a portion of a longitudinal cross-section through the stator, similar to that shown in FIG. 1, showing an alternate embodiment of the invention.

Although, as shown in FIG. 4*a*, only the radially extending fibers 26 contact the housing 6, other fibers can also be arranged so as to contact the housing depending on their orientation. For example, with reference to FIG. 4, fibers 22 in the outmost layers, which may extend circumferentially or transversely to the helix angle, can be arranged so as to periodically contact the housing 6 at a number of locations along their lengths, such as in the portions of the stator core 8 that form the grooves 16–19, by exaggerating the undulations in the fibers. Similarly, fibers 22', which may extend axially, can be arranged so as to periodically contact the housing 6. For example, the fibers 22' can be made to follow the undulating longitudinal profile of the core surface 12 so as to periodically contact the housing 6 at locations 50, each of which are separated by a pitch length, as shown in FIG. 8. If desired, fibers from other layers can also be made to contact the housing 6 at locations 50 by, for example, further exaggerating the undulations in those fibers. For example, fibers 23' can also be made to contact the housing 6 at locations 50, as shown in FIG. 8

Although the fibers can be incorporated throughout the entire stator core 8, preferably, the fibers are incorporated in only the inner section adjacent the surface 12, as shown in FIG. 4. The outer section of the core is preferably comprised of pure elastomer 9. Preferably, the inner section that incorporates the fibers forms at least half of the radial thickness of the stator core 8.

As shown in FIG. 4, preferably, the innermost fiber layer, which is formed by fibers 25 and 25', approximately follows, or parallels, the undulating profile of the inner surface 12 of the stator core 8. The radial thickness "T" of the layer of elastomer 9 between the innermost fabric layer 25, 25' and the inner surface 12 of the stator core 8 is preferably in the range of about 0.05 to about 0.2 inch. Although a constant radial spacing between the fabric layers could be maintained around the circumference of the stator core 8. The radial spacing G preferably varies around the circumference so that the fabric layers are more closed spaced in the region of the grooves 16–19 and less closely spaced in the regions 17 between the grooves, as also shown in FIG. 4.

The stator core 8 according to the current invention is preferably made by employing a mandrel having an outer profile that is the reverse of the inner surface 12 of the stator core 8—that is, there is a corresponding outward projecting lobe on the mandrel for each inward projecting groove 16–19 in the stator core—so that the two surfaces "match." The mandrel is then inserted into a weaving machine supplied with the fibers 22–25. First, the innermost fabric layer 25, 25' is woven around the mandrel so as to form of an essentially cylindrical sheath extend the length of the stator core 8. Successive layers are woven by successive passes of the weaving machine, with the outermost layer 22, 22' being formed last.

Alternatively, a fabric layer could be woven as a flat sheet without aid of a mandrel. The fabric sheet is then wrapped repeatedly around a mandrel to form the fabric layers.

Encapsulation of the fibers 22–25 within the elastomer 9 matrix can be accomplished in several ways. Liquid elastomer 9 can be coated onto the fibers 22–25 as they are being woven. Alternatively, a coating of liquid elastomer 9 can be applied to each layer of fabric prior to the next pass of the weaving machine. After completion of the weaving, additional coats of elastomer 9 can be applied to form the outer section of the stator core 8.

In yet another embodiment, the weaving and layering of the fabric can be performed without application of elastomer 9. Although the stiffness of the fibers can be relied upon to provide dimensional stability to the fiber skeleton, preferably the fibers are brazed or epoxied together where they contact each other in order to provide additional dimensional stability. This can be accomplished by, for example, coating the fibers with a brazing material and then, after weaving, heating the fiber skeleton in an oven to form the braze joints, or by coating the fibers with epoxy prior to weaving and then allowing the epoxy to cure after weaving. In any event, the woven fiber skeleton is then placed between molds having outer and inner profiles, respectively, that match the undulating inner surface 12 and the cylindrical outer surface of the stator core 8. Liquid elastomer can then be injected to the mold, thereby filling the gaps between the fibers.

Regardless of the method used to incorporate the elastomer, after the elastomer cures, a solid fiber encapsulated stator core is created.

According to one aspect of the current invention, the tension in the fibers during weaving can be controlled so as to vary the radial spacing of fabric layers around the circumference, as previously discussed. For example, by increasing the tension in the fibers as successive layers are formed, the inward deflection of the fabric in the areas 17 between grooves 16–19 will become more shallow so as to more closely match a circle, creating the variable spacing shown in FIG. 4.

Figure 6:
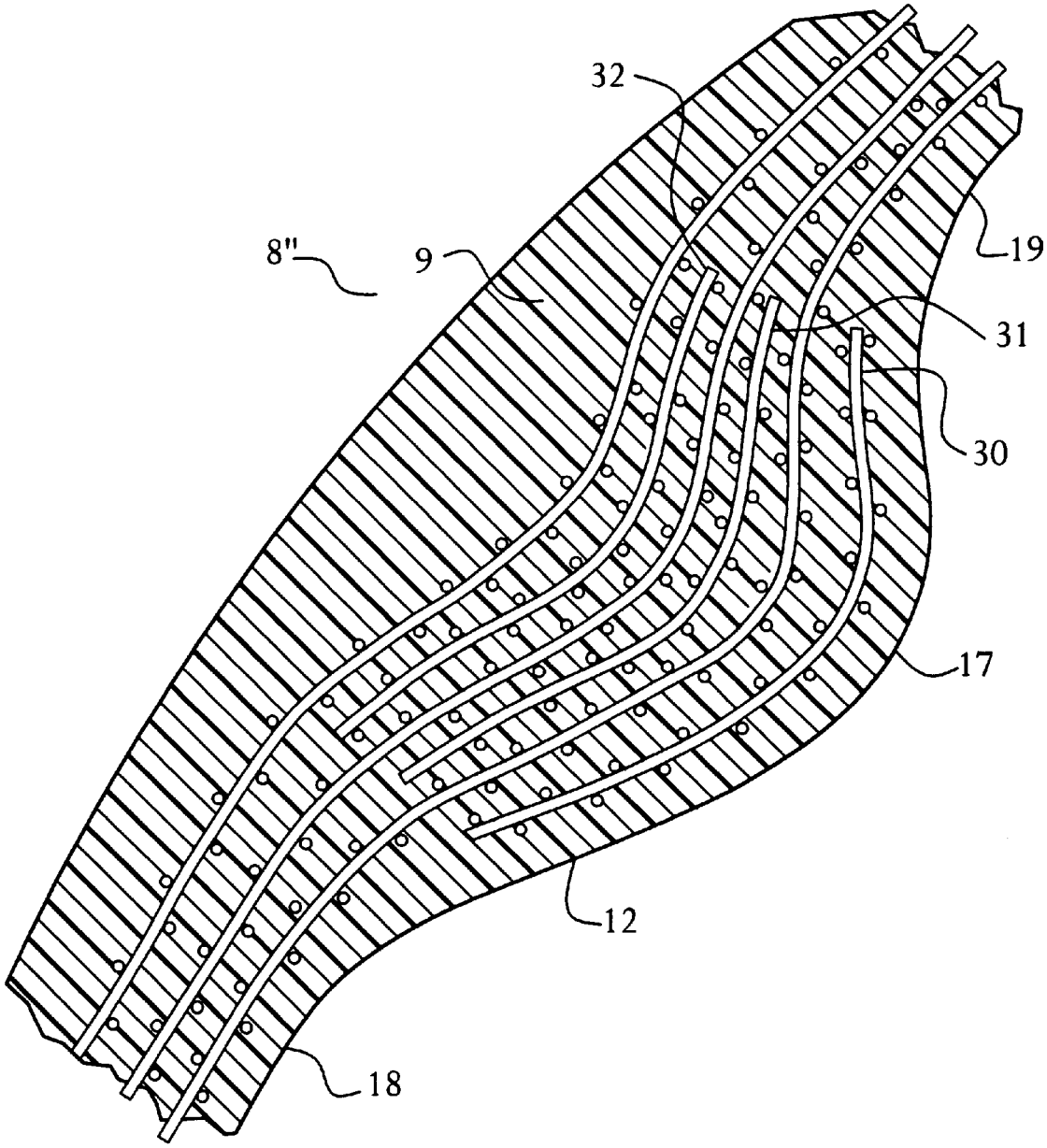
FIG. 6 is a view similar to FIG. 4 showing an alternate embodiment of the stator core in which strips of fabric are interleaved with layers of fabric

Alternatively, the fabric can be made to conform to the inner surface 12 of the stator core 8 by interleaving strips of woven fabric 30–31 between fabric layers in the thick areas 17 of the stator core, as shown in FIG. 6. This can be accomplished, for example, by laying a fabric strip around the stator core 8, in a helical orientation that follows the path of tee portions 17 between the grooves 16–19, after each pass of the weaving machine. The fabric strips 30–31 can be cut from fabric separately woven from the same fibers as the continuous layers.

Figure 7:
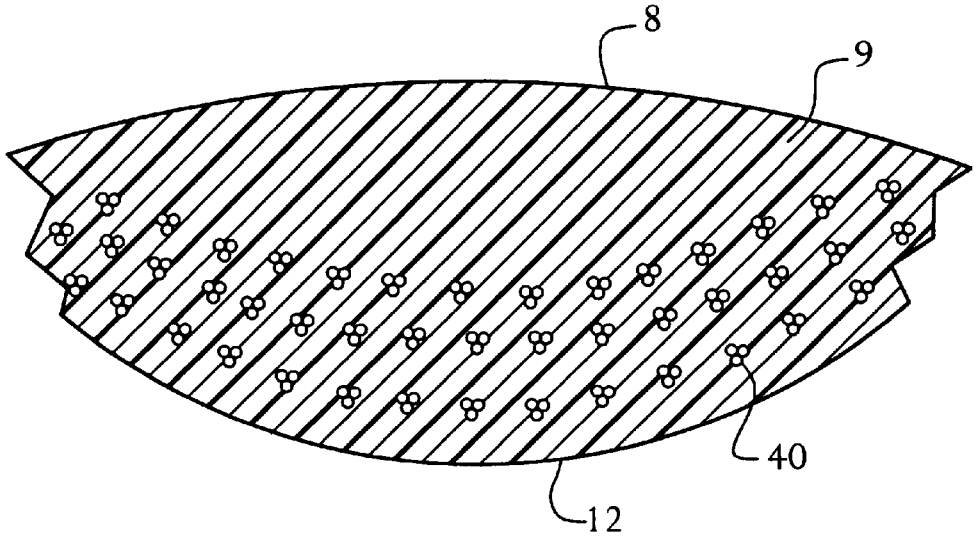
FIG. 7 is a portion of a longitudinal cross-section through an alternate embodiment of the current invention in which the fibers are braided.

Although it is preferable to form the fibers into multidimensional network, for example, by weaving orthogonal sets of fibers into a fabric as previously discussed, the invention can also be practiced by wrapping the fibers around stator core 8 in an essentially one-dimensional array, for example, by dispensing with the fibers 22', 23', 24' and 25' shown in FIGS. 4 and 5 The fibers are then encapsulated in elastomer 9, as discussed above. In this configuration, the fibers can be oriented transversely to the stator axis or perpendicular to the helix angle, for example. Further, the fibers can be formed into braids 40, as shown in FIG. 7, by braiding several fiber strands together prior to, or during, the wrapping of the fibers about a mandrel. The braids 40 can be wrapper in layers similar to that previously discussed in connection with fibers woven into a fabric and preferably extend transversely around the stator.

The stator core formed according to the current invention has improved strength and rigidity compared to conventional solid elastomer stator cores so as to ensure that an interference fit will be achieved and maintained between the stator 2 and rotor 4, thereby providing good sealing of the cavities 14. Nevertheless, a stator core according to the current invention will be sufficiently flexible to undergo the required elastic deformation upon impact with the rotor lobes 18.

Perhaps more importantly, the fibers form heat conduction paths that improve heat transfer within the stator. For example, in the embodiment shown in FIGS. 4 and 5, the fiber network aids in the transfer of heat from the thick portions 17 of the stator core 8 between the grooves 16–19 that are subject to the maximum heat generation to the thinner portions within the grooves. Further, the use of a radial array of fibers, such as those in the embodiment shown in FIG. 4*a*, aids in transferring heat radially outward. Improving the heat transfer characteristics of the stator results in increased heat dissipation to the working fluid, thereby cooling the stator. Moreover, if the fibers are in contact with the housing 6, they permit the housing to act as a second heat sink in addition to the working fluid, thereby further improving the heat transfer. As can be readily appreciated, this improved heat transfer capability prevents overheating of the portions of the elastomer subject to the highest cyclic stresses. In any event, the fibers serve to strengthen and stiffen the elastomer so that it is better able to withstand a certain amount of degradation in properties without failure or chunking and can operate with less interference with the rotor without leakage.

Although the current invention has been illustrated in connection with a helicoidal type pump/motor, the invention is also applicable to other fluid handling devices in which an elastomeric stator is used. Accordingly, the present invention may be embodied in other specific torn without departing from the spirit or essential attributes thereof and, accordingly, reference should be made to the appended claims, rather than to the foregoing specification, as indicating the scope of the invention.

What is claimed:

1. A helicoidal fluid handling device suitable for use as a positive displacement pump or motor, comprising:

a) an elongate rotor, said rotor having at least one lobe projecting radially outward and extending helically along the length of said rotor; and b) a substantially cylindrical stator comprising an elastomeric form having an inner surface, first portions of said elastomeric form forming a number of grooves in said inner surface extending helically along the length of said stator, said number of grooves being one more than the number of lobes in said rotor, second portions of said elastomeric form forming a projection on said inner surface between each of said grooves, said projections extending helically along the length of said stator, said stator enclosing said rotor such that relative rotation between said rotor and said stator causes said portions forming said projections to undergo cyclic deformation, said cyclic deformation generating heat within said projections thereby creating a temperature gradient within said elastomeric form; said elastomeric form comprising means for reducing said temperature gradient by distributing said heat from said portions of said elastomeric form forming said projections to said portions forming said grooves, said means for reducing said temperature gradient comprising a network of thermally conductive fibers encapsulated in an elastomeric material, said network of thermally conductive fibers comprising at least a first group of fibers extending from said portions forming said projections to said portions forming said grooves so as to transfer heat from said portions forming said projections to said portions forming said grooves.

2. The fluid handling device according to claim 1, wherein said stator grooves define a helix angle, said fibers in said first group extending at an angle to said helix angle.

3. The fluid handling device according to claim 1, wherein a plurality of gaps are formed between said fibers forming said network of fibers, said gaps being filled by said elastomeric material.

4. The fluid handling device according to claim 1, wherein said stator further comprises a housing enclosing said elastomeric form, and wherein at least a portion of said fibers forming said network of fibers are in contact with said housing.

5. The fluid handling device according to claim 1, wherein said stator further comprises a housing enclosing said elastomeric form, and wherein at least a portion of said fibers forming said network of fibers periodically contact said housing at a plurality of locations along the lengths of said fibers.

6. The fluid handling device according to claim 1, further comprising means for interlocking at least a portion of said fibers forming said network of fibers so as to restrain relative motion between said fibers.

7. The fluid handling device according to claim 1, wherein said elastomeric form inner surface has a profile that forms an undulating surface, and wherein said network of fibers forms a layer oriented within said elastomer so as to substantially follows said undulations.

8. The fluid handling device according to claim 1, where said elastomeric form is made by the process of weaving a plurality of fibers around a mandrel so as to form a plurality of fabric layers.

9. The fluid handling device according to claim 1, wherein said elastomeric form inner surface has a profile that forms an undulating surface, and wherein at least a portion of said fibers in said fiber network substantially follow said undulations.

10. The fluid handling device according to claim 1, wherein said stator defines a longitudinal axis thereof and said elastomeric form has an outer surface, wherein said fibers in said first group are radially displaced from said axis by a distance that varies as said fibers extend from said portions of said elastomeric form forming said projections to said portions forming said grooves so as to also transfer heat radially toward said outer surface of said elastomeric form.

11. The fluid handling device according to claim 1, wherein said network of fibers comprises a second groups of fibers, said fibers in said first group extending in a first direction, said fibers in said second group extending in a second direction.

12. The fluid handling device according to claim 11, wherein said first direction is an axial direction.

13. The fluid handling device according to claim 11, wherein said first direction is a circumferential direction.

14. The fluid handling device according to claim 11, wherein said first and second directions are approximately mutually perpendicular.

15. The fluid handling device according to claim 11, wherein at least a portion of said fibers in said first group are in contact with at least a portion of said fibers in said second group.

16. The fluid handling device according to claim 1, wherein said fibers forming said network of fibers are interlaced.

17. The fluid handling device according to claim 16, wherein said network of interlaced fibers is formed by weaving together a plurality of said fibers.

18. The fluid handling device according to claim 1, wherein at least a portion of said fibers forming said network of fibers are interlocked with each other.

19. The fluid handling device according to claim 18, wherein said interlocking is accomplished by knitting together at least said portion of said fibers.

20. The fluid handling device according to claim 1, wherein said network of fibers forms a fabric layer.

21. The fluid handling device according to claim 20, wherein said fabric extends circumferentially around said elastomeric form.

22. The fluid handling device according to claim 20, wherein said network of fibers forms at least one additional fabric layer, whereby said network of fibers forms a plurality of fabric layers encapsulated by said elastomeric material.

23. The fluid handling device according to claim 22, wherein said elastomeric form is made by the process of repeatedly circumferentially wrapping said fabric around a mandrel so as to form said plurality of fabric layers.

24. The fluid handling device according to claim 22, wherein said fabric is layered so that in transverse cross-section each of said layers is disposed radially outward from an adjacent layer except for an innermost layer.

25. The fluid handling device according to claim 24, wherein said elastomeric form further comprises a plurality of strips of a fabric interspersed between said fabric layers.

26. The fluid handling device according to claim 25, wherein said strips of fabric are disposed in said portions of said elastomeric form located between said grooves.

27. The fluid handling device according to claim 1, wherein said stator further comprises a housing enclosing said elastomeric form, and wherein said first group of fibers are in contact with said housing.

28. The fluid handling device according to claim 27, wherein said first group of fibers periodically contact said housing at a plurality of locations along their lengths.

29. The fluid handling device according to claim 27, wherein said first direction is substantially radial.

30. A helicoidal fluid handling device suitable for use as a positive displacement pump or motor, comprising:

a) an elongate rotor, said rotor having at least one lobe projecting radially outward and extending helically along the length of said rotor; and b) a stator enclosing said rotor, said stator comprising an elastomeric form having an inner surface, said inner surface forming a number of grooves extending helically along the length of said stator, said number of grooves being one more than the number of lobes in said rotor, said elastomeric form comprising a network of fibers encapsulated in an elastomeric material; said network of fibers comprising at least first, second and third groups of fibers, said fibers in said first group extending in a first direction, said fibers in said second group extending in a second direction, said fibers in said third group extending in a third direction.

31. A helicoidal fluid handling device suitable for use as a positive displacement pump or motor, comprising:

a) an elongate rotor, said rotor having at least one lobe projecting radially outward and extending helically along the length of said rotor; and b) a stator enclosing said rotor, said stator comprising an elastomeric form having an inner surface, said inner surface forming a number of grooves extending helically along the length of said stator, said number of grooves being one more than the number of lobes in said rotor, said elastomeric form comprising a network of fibers encapsulated in an elastomeric material and means for interlocking at least a portion of said fibers forming said network of fibers so as to restrain relative motion between said fibers, said means for interlocking comprises at least said portion of said fibers being brazed to each other.

32. A fluid handling device, comprising:

a) an elongate rotor;

b) a substantially cylindrical stator defining a longitudinal axis thereof and enclosing said rotor, said stator including an elastomeric form having an inner surface encircling said rotor, said elastomeric form comprising means for transferring heat radially within said elastomeric form, said heat transfer means comprising a plurality of thermally conductive fibers dispersed throughout at least a portion of said elastomeric form and encapsulated therein, at least a portion of said fibers extending along a path that is radially displaced from said longitudinal axis by a distance that varies as said fibers extend along said path, whereby said portion of said fibers conducts heat radially.

33. The fluid handling device according to claim 32, wherein said plurality of fibers comprise at least first and second groups of fibers, said fibers in said first group extending in a first direction, said fibers in said second group extending in a second direction.

34. The fluid handling device according to claim 33, wherein said fibers in said first and second groups are interlaced.

35. A helicoidal fluid handling device suitable for use as a positive displacement pump or motor, comprising:

a) an elongate rotor, said rotor having at least one lobe projecting radially outward and extending helically along the length of said rotor; and b) a stator enclosing said rotor and defining an axis thereof, said stator including an elastomeric form having an inner surface forming a number of grooves and extending helically along the length of said stator, said number of said grooves being one more than the number of said lobes, said elastomeric form comprising a plurality of braided fibers encircling said axis and encapsulated in an elastomeric material.

36. A helicoidal fluid handling device suitable for use as a positive displacement pump or motor, comprising:

a) an elongate rotor, said rotor having at least one lobe projecting radially outward and extending helically along the length of said rotor; and b) a substantially cylindrical stator defining a longitudinal axis thereof and comprising a elastomeric form having inner and outer surfaces, a first portion of said elastomeric form forming a number of grooves on said inner surface, each of said grooves projecting radially inward and extending helically along the length of said stator, said number of grooves being one more than the number of lobes in said rotor, a second portion of said elastomeric form forming a projection on said inner surface between each of said grooves, said projections extending helically along the length of said stator, said stator enclosing said rotor such that relative rotation between said rotor and said stator causes said portions of said elastomeric form forming said projections to undergo cyclic deformation, said cyclic deformation generating heat within said portions forming said projections; said elastomeric form comprising means for transferring said generated heat radially outward toward said elastomeric form outer surface, said heat transfer means comprising a network of thermally conductive fibers encapsulated in said elastomeric form, at least a portion of said fibers oriented along a path that extends at least partially through said portions of said elastomeric form forming said projections, each of said fiber paths being radially displaced from said longitudinal axis by a distance that varies along said path, whereby said fibers in said first group transfer heat radially outward toward said outer surface of said elastomeric form.

37. The fluid handling device according to claim 36, wherein said fiber paths extend directly radially outward.

38. The fluid handling device according to claim 36, wherein said fiber paths are radially displaced from said longitudinal axis by a distance that varies by forming undulations.

* * * * *